US009340913B1

(12) United States Patent
Gala et al.

(10) Patent No.: US 9,340,913 B1
(45) Date of Patent: May 17, 2016

(54) DEVICES FOR HOLDING FABRICS DURING EMBROIDERING

(71) Applicants: Mansukhlal K. Gala, North Haven, CT (US); Amar M. Gala, North Haven, CT (US)

(72) Inventors: Mansukhlal K. Gala, North Haven, CT (US); Amar M. Gala, North Haven, CT (US)

( * ) Notice: Subject to any disclaimer, the term of this patent is extended or adjusted under 35 U.S.C. 154(b) by 0 days.

(21) Appl. No.: 14/599,346

(22) Filed: Jan. 16, 2015

Related U.S. Application Data

(60) Provisional application No. 61/928,765, filed on Jan. 17, 2014.

(51) Int. Cl.
*D05C 9/04* (2006.01)

(52) U.S. Cl.
CPC ..... *D05C 9/04* (2013.01)

(58) Field of Classification Search
CPC ..... D05B 21/00; D05B 5/00; D05B 11/00; D05C 9/04; D05C 1/04
USPC ..... 112/102, 103, 104, 118, 119, 475.18; 38/102, 102.2, 102.91
See application file for complete search history.

(56) References Cited

U.S. PATENT DOCUMENTS

| | | | | | |
|---|---|---|---|---|---|
| 892,961 | A * | 7/1908 | Kohler | ..... | 38/102.2 |
| 1,098,442 | A * | 6/1914 | Huyck | ..... | 38/102.2 |
| 1,229,857 | A * | 6/1917 | Alyea | ..... | 38/102.2 |
| 4,085,532 | A * | 4/1978 | Hehn | ..... | 38/102.2 |
| 4,247,998 | A * | 2/1981 | Foss | ..... | 38/102.2 |
| 4,642,924 | A * | 2/1987 | Sudderth et al. | ..... | 38/102.2 |
| 6,298,800 | B1 | 10/2001 | Gala | | |
| 6,640,735 | B2 | 11/2003 | Kwang | | |
| 7,194,967 | B2 | 3/2007 | Bowlus | | |
| 7,255,052 | B2 | 8/2007 | Okazaki | | |
| 8,739,710 | B1 * | 6/2014 | Taylor | ..... | 112/103 |
| 2011/0277674 | A1 | 11/2011 | Schlomske | | |

* cited by examiner

*Primary Examiner* — Tejash Patel
(74) *Attorney, Agent, or Firm* — C. Nessler

(57) ABSTRACT

Embroidering apparatus comprises an inner hoop and a circumscribing outer hoop which captures and holds fabric firmly in place. An outer hoop has a closure at the gap/split location. Closures variously comprise springs that urge the split-ends of the hoop toward one another. Sleeves around gap-adjusting rods and gauge bars provide visual indicators display the amount of gap or spring compression, to enable quick adjustment and pre-setting of the outer hoop dimension. A fixture for holding an element that is small than the bore of the hoop is mounted on an inner hoop by means of magnetic or spring-tabs. One fixture comprises two spaced apart rail assemblies, each having a hinged and slotted cover.

22 Claims, 11 Drawing Sheets

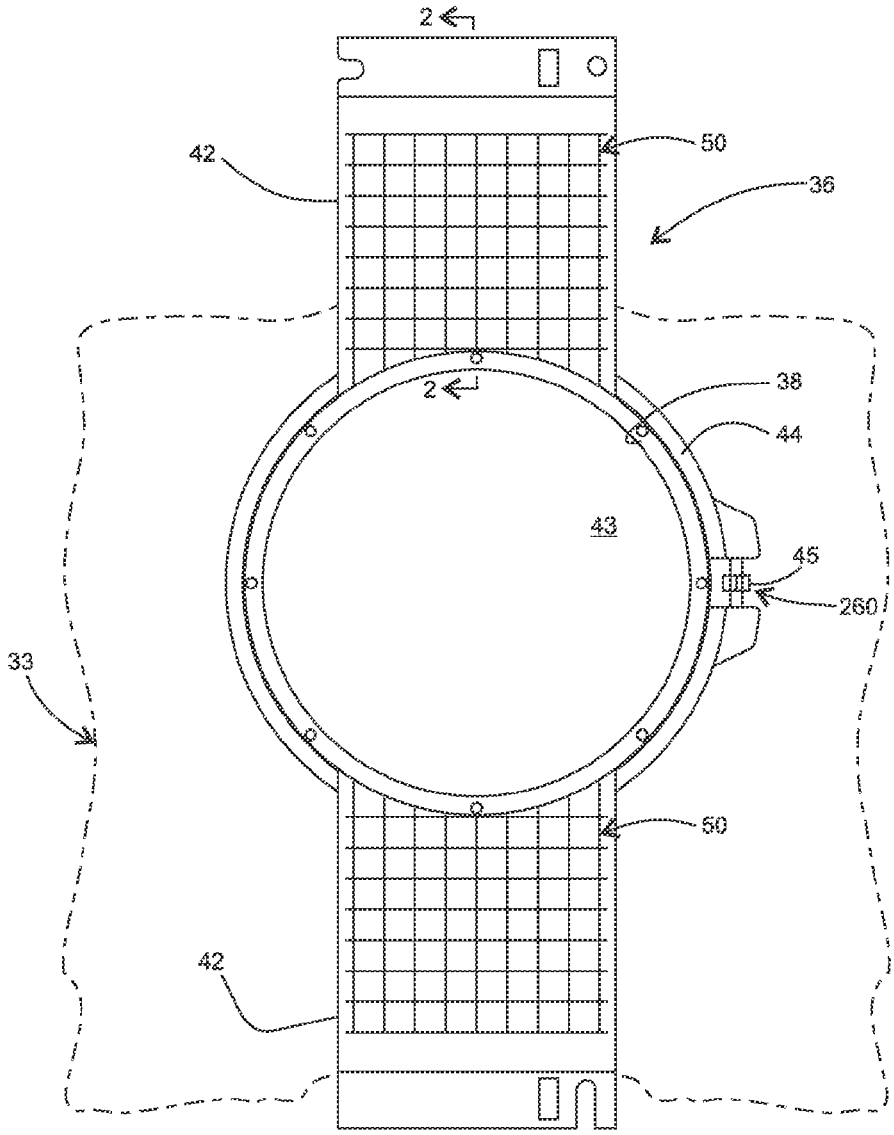
FIG. 1 - PRIOR ART
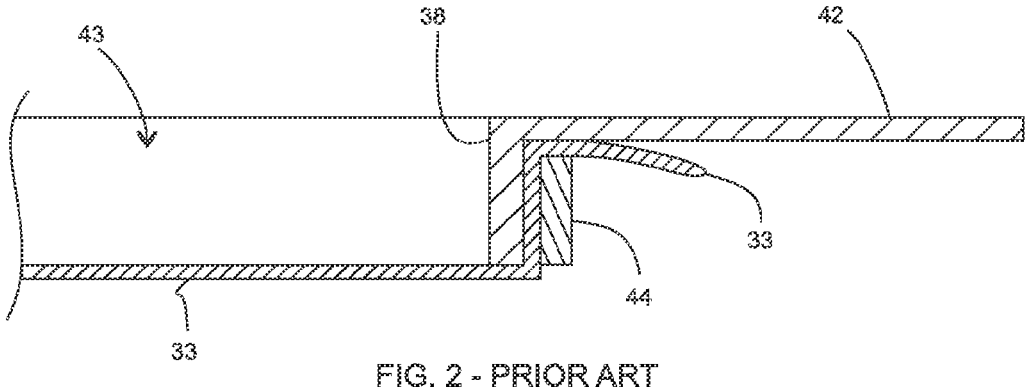
FIG. 2 - PRIOR ART

DEVICES FOR HOLDING FABRICS DURING EMBROIDERING

This application claims benefit of provisional patent application Ser. No. 61/928,765, filed Jan. 17, 2014.

TECHNICAL FIELD

The present inventions relate to apparatus for embroidering fabrics, in particular to devices suited for holding the articles to be embroidered on an embroidery machine or manually.

BACKGROUND

Technology for embroidering on a production basis is described in commonly owned U.S. Pat. No. 6,298,800 "Embroidery Apparatus" and elsewhere in the art. In connection with the present invention, embroidery manufacturing comprises use of a fabric-holding device, also known as embroidery frames, hoops, rings, and other terms. In factory production, the device is removably mounted on an embroidery machine, to hold fabric or other material so it can be embroidered. Typically, a first fabric-holding device will be removed from the machine after an article has been machine-embroidered. Then a second like device holding a second article will be quickly inserted into the machine and the second article will be embroidered, and so forth, on a repetitive basis. It follows that the fabric-holding devices have to be loaded and unloaded quickly and consistently.

In typical present practice, fabric is captured between the outside surface of an inner hoop and the bore of an outer hoop. The hoops are held in place by friction, when the outer hoop presses the fabric radially inward, against the outside surface of the inner hoop, as illustrated by FIG. 2 here, discussed below. Typically, an outer hoop has a split, the opposing features of which define a gap. And the diameter (or comparable dimension of a non-circular hoop) is adjustable by means of a screw which part of the closure assembly associated with the split. The closure enables a user to adjust the bore dimension of the outer hoop and obtain the proper tightness in the fit with the inner hoop and resultant good tightness of the fabric. It follows that the dimension of an outer hoop has to be changed according to the thickness and other properties of the fabric or garment being embroidered. It is desirable to improve the speed and repeatability of making such adjustments.

In another aspect of mass production embroidering, a patch, pocket or other sub-element is embroidered and affixed to a larger article, such as a garment. During that process the smaller sub-element has to be held in position within the opening of a hoop, while it is worked on, to stitch and secure it to the larger article which is held within the opening of the hoop.

A similar problem is presented when an article is small relative to the size of the hoop which is being used. For example, suppose a belt or strap is being embroidered. One way of holding such smaller items within the opening of a hoop is described in Schlomeke et al. Pat. Pub. No. 2001/02776674. Further improvements are sought. A small item, or a fabric sub-element which is being attached to a larger fabric item during embroidering, must be reliably and consistently held in position during the stitching process. And a fixture which holds a smaller piece of fabric should be able to be positioned quickly and easily with respect to a hoop, when the hoop is placed in an embroidery machine.

SUMMARY

An object of the invention is to provide hoops and fixtures for holding fabric for embroidering by hand or by use of an embroidery machine. Another object is improve the utility of both inner and outer hoops which hold fabric for embroidering; for instance, to provide an outer hoop which has a bore which is adjustable in dimension in quick and repeatable fashion, and to provide a hoop assembly which accommodates considerable variation in the thickness of the fabric which is being held. Another object is to provide fixtures that mount on a hoop, for holding securely and efficiently a fabric element that is smaller than the dimension of the hoop. Another object is to improve the ease and repeatability with which fixtures may be inserted and removed from a hoop assembly.

Outer hoop embodiments of the present invention are used in combination with an inner hoop, to hold fabric so that fabric may be embroidered. An outer hoop has split/gap, so it can change in dimension. One outer hoop embodiment has spaced apart buttresses that oppose each other at the location of a split/gap in the outer hoop. A closure of the hoop at the split/gap comprises buttresses which are connected by a rod or pin, and comprises at least one spring which resiliently urges the buttresses toward one another. For example, a double-headed pin, or a rotatable rod having a threaded shaft, runs from a hole in one buttress to the other buttress; and a coil spring is captured around the pin or rod in one buttress or both buttresses. Optionally, a spacer limits the minimum gap size. The spring(s) allows the hoop to increase in bore dimension.

In another embodiment of the outer hoop invention, the dimension of gap or the amount of compression of a spring within a buttress is visually indicated by one of: (a) a multiplicity of adjacent sleeves around the shaft of the rod which is part of the closure—where the sleeves may be differentiated from each other by size, color, texture, marking, or location along the shaft; (b) a barrel indicator circumscribing the shaft of the rod which is part of the closure; (c) a gauge bar affixed to the buttress of other portion of the hoop on one side of the gap and extending across the gap; and, (d) a gauge bar integral with a second buttress and located in proximity to the end of said shaft portion which is furthest from the knob portion at the first buttress. An alternate embodiment of gauge may visually indicate the extent to which a rod is received in a second buttress, when the end of the rod is exposed at one buttress. The visual displays enable quick and repeatable changes between different lots of fabrics and products which are being embroidered; and they can enable repetition of settings from a previous-done job.

In other embodiments of the invention, a fixture holds a second piece of fabric element within the bore of an inner hoop which may or may not have a first piece of fabric held by an outer hoop engaged with the inner hoop. One embodiment of fixture has a plurality of tabs for holding the fixture on the inner hoop, and each tab is one of (a) a tab comprising a downward extending lip which springily engages the inner hoop or outer hoop, (b) a magnetically susceptible tab which is attracted to a magnet embedded in the inner hoop or outer hoop, or (c) screws, or (d) combinations thereof. An invention fixture is thus held securely in place during embroidering, yet is easily removed and replaced.

Another fixture embodiment of the invention comprises two spaced apart rail assemblies, mounted on a support bracket which is engaged with the inner hoop. The rail assemblies are positioned for holding a smaller fabric element within the bore of an inner hoop. Each rail assembly comprises a base and a hinged cover. During use, the smaller fabric element runs through and/or under the latched-down cover of a first rail assembly, so it is firmly held, to the spaced apart second rail assembly where it is similarly held. The fixture can hold for embroidering a fabric element that is smaller than the hoop being used, such as a belt or ribbon or other such object, whether or not other fabric is also being held on the inner hoop by an outer hoop. In another embodiment of the invention, the bore of the inner hoop has an inwardly extending ledge with indicia, to enable better alignment of the fabric with the orientation of a hoop.

The foregoing and other features and advantages of the invention will be appreciated from the description which follows.

BRIEF DESCRIPTION OF THE DRAWINGS

FIG. 1 is a top view of a prior art assembly useful for mounting fabric or a garment within an embroidery machine. The assembly comprises an inner hoop having arms, and an outer hoop.

FIG. 2 is a partial vertical cross section through the hoops of the prior art device shown in FIG. 1, indicating how a fabric is captured between the inner and outer hoops.

DESCRIPTION

Figure 3:
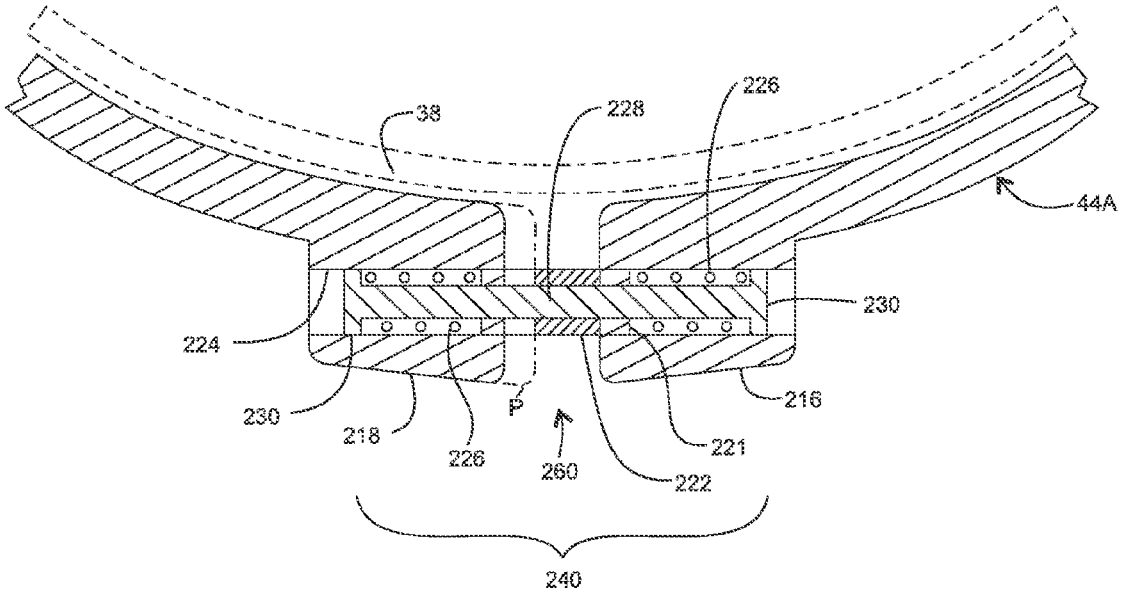
FIG. 3 is a partial cross section, in the plane of the hoop circularity, showing the split region of an outer hoop embodiment which comprises a closure-with-spring. A spacer is in the gap at the hoop split.

This application claims benefit provisional patent application Ser. No. 61/928,765, filed Jan. 17, 2014, the disclosure of which is hereby incorporated by reference. The present inventions are exemplarily described in connection with their use in an embroidering machine. In general, the inventions may also be used by those who embroider things by hand stitching.

The present inventions have relation to U.S. Pat. No. 6,298,800, the disclosure of which is hereby incorporated by reference. FIG. 1 herein is a top view of an embroidery device 36, as pictured in U.S. Pat. No. 6,298,800. FIG. 2 herein is a cross section through a portion of the device of FIG. 1, which typically is mostly made of injection molded plastic. Generally, the prior invention relates to indicia 50 which help a user align the fabric being embroidered with the device 36. Device 36 comprises opposing side arms 42 which support the device when it is mounted in an embroidering machine As described in the referenced patent, and as shown in FIG. 1 and FIG. 2 herein, during use of a device 36, fabric 33 (shown in phantom) is stretched across the underside of the opening 43 of inner ring/hoop 38 which is integral with arms 42. The fabric 33 is captured at the periphery of inner hoop 38, and is held in place by means of outer ring/hoop 44. Hoop 44 is sized so it nominally fits the outside circumference of the inner hoop 38, and when properly adjusted, fits tightly around the fabric where it is gathered around the outside surface of inner ring 38. A screw 45, operating similar to a turnbuckle, opens and closes the gap 260 at a radial-running split in the circumferential structure of the outer hoop 44. Such change in gap size causes change in the diameter of the bore of the outer hoop. Thus, the outer hoop may be correctly sized so the outer hoop firmly holds fabric 33 against the outside surface of inner ring 38. The desirable outer hoop dimension will change according to the thickness of the fabric which is being worked on, and the fabric tightness which the user desires. In this application, a reference to the closure of a hoop comprehends the portions of the hoop adjacent the split along with the means for holding or adjusting the gap spacing between the portions of the hoop.

In the embroidery industry, a ring 38 and hoop 44 are often called frames, more particularly an inner frame and an outer frame, respectively. See for instance, the website www.alliedi.com or www.embroideryframe.com. The ring/hoop elements may also be referred to in the art interchangeably as clamps, fabric holding devices, etc. When an article is captured between a ring and hoop, it is often said to be "framed" or "hooped". In the U.S. Pat. No. 6,298,800 patent, the term "frame" is used to describe an element 56 shown in FIG. 25 of the patent. See Col. 6, line 6-40. Compare, Col. 4, line 66, where it says "the hoop is also sometimes referred to as a frame." Compare, Col. 5, line 16, where an entire assembly 36 for holding fabric in a machine is referred to as the hoop.

To attempt to avoid confusion amongst the U.S. Pat. No. 6,298,800 patent, other prior art, and this present description, the term frame will be used sparingly. In this description the terms ring and hoop are used interchangeably for the same kind of element; and, it will be understood that the terms encompass embodiments which are circular and non-circular. The invention is exemplarily described here in terms of embroidering fabric. The term fabric will ordinarily pertain to woven and non-woven sheets, but in the generality of the invention it will be understood that the term will apply to other kinds of sheets, such as films of plastic, paper, rubber, leather, wood, etc. The present inventions are exemplarily described in connection with their use in an embroidering machine; but that is not a general limitation, since the inventions may be used for embroidering things by hand stitching.

The approach in this description is, first, to describe hoop combinations, in particular outer hoops having novel closures, including closures with gauge bars and other gauging means. Then fixtures which may be used with hoops of the present invention or with hoops in the prior art are described.

Hoops

The way in which fabric is placed between the inner and outer hoops is familiar to those in the embroidery field. Generally, with reference to how the assembly of FIG. 2 is created, fabric 33 is first laid across the opening of an outer hoop 44 as it rests on a work table. An inner hoop, for instance the hoop 38 which is integral with arms 42, as shown in FIG. 1, is then pressed downwardly onto the fabric so the inner hoop/ring 38 is forced into the opening of the outer hoop 44. That jams and captures the fabric tightly in the space between the bore of the outer hoop and the outside surface of the inner hoop. The jamming action causes the fabric 33 to become taut across the opening of the inner hoop 38, whereupon it is ready for embroidering when the assembly is placed in an embroidering machine, as described in U.S. Pat. No. 6,298,800. It will be appreciated that there is relative movement of hoops. Thus, as below, it may alternatively be stated that the outer hoop is being forced over the inner hoop.

It should be apparent that to accomplish the desired result there has to be a particular fit or spacing between the inner and outer hoops; and, that such desirable fit may vary with the weight, thickness and other properties of the fabric being processed. In the prior art, the outer hoop has a split and has an adjustable closure, such as the screw-turn device 45 of hoop 44 in FIG. 1. While generally effective, the prior technology requires accurate adjustment of the closure so the diameter of the hoop 44 is correct and that there is consistent dimension for any given number of like hoops being used concurrently for the same production job on multiple embroidery heads and/or machines.

An outer hoop should fit over the inner hoop tightly enough to hold the fabric taut within the opening of the inner hoop when the outer hoop is in its embroidery-machine working position. But at the same time the outer hoop should not be so tight that removal of the outer hoop from its working position is difficult, particularly in a production environment. An outer hoop which is adjusted too tightly can also leave unwanted rub marks on the fabric being held. To handle different articles which have different thickness fabrics requires that the hoop be made larger or smaller to fit the current type of item. In practice, when the article being processed is changed, operators may not be skillful at re-setting an old technology hoop diameter correctly and/or consistently for a multiplicity of hoops which are typically being used. And it is desirable for good and efficient embroidery production to minimize any fidgeting or experimenting with hoop size, from one job to the next. The present invention enables achieving such aims.

FIG. 3 is a cross section plan view (i.e., a view looking onto the plane of the hoop circumference) of the portions of a hoop adjacent where it is split. FIG. 3 shows the closure 240 of an embodiment of an improved outer hoop 44A. In FIG. 3, closure 240 comprises a double-headed shaft 228 which runs between opposing side buttresses 216, 218. The buttresses at the ends of the hoop 44A where there is a split defining a gap 260 that enables change in diameter of the hoop. The hoop 44A is shown in its working or use position relative to the periphery of an inner ring 38, shown in phantom, as the hoops would capture fabric (not shown). The ability of hoop 44A to change diameter, in particular, to become smaller due to the action of springs 226, is illustrated by the phantom P.

In the FIG. 3 embodiment, the left and right sides of the hoop at the split location are similar. Each end of shaft 228 has a head 230 which captures a coil spring 226 within a bore 224 of a buttress 218, 216. In an alternative embodiment not shown, but which will be evident to the artisan, one end of the shaft 228 is contained within one buttress without a spring, and the head 230 of such one end is in contact with a shoulder 221. It will be understood that at least one head 230 can be a button screw, to facilitate assembly of the device or change in dimension of the spacer 222, discussed just below. And in this and other embodiments where a shaft or pin spans the gap, the fit of the shaft or pin within the bore hole or other receiving feature of a buttress will have sufficient clearance, or looseness of fit, to enable slight canting of one buttress relative to the other as the dimension of the gap changes.

A spacer 222 is positioned around the shaft 228 within the gap 260 between the buttresses of hoop 44A. The spacer 222 limits the minimum dimension of gap 260 and thus the minimum diameter of the hoop, to desired predetermined dimensions. In an alternative embodiment hoop 44A, there is no spacer and the minimum bore of the hoop will be determined by contact of the buttresses with each other.

When an inner hoop 38 with accompanying fabric is pressed into the bore of a hoop 44A, the gap 260 between the buttresses can increase because the diameter of the hoop is forced to increase, and springs 226 will be compressed. The compressed springs will exert force upon the buttresses, causing the buttresses to move towards each other. Thus, according to the choice of springs 226 and the extent to which the hoop is forced to expand in diameter, there will be predictable and sufficient force applied by the outer hoop 44A against the fabric lying on the exterior surface of the inner hoop 38. That will keep the hoops engaged, frictionally capturing the fabric.

Figure 4:
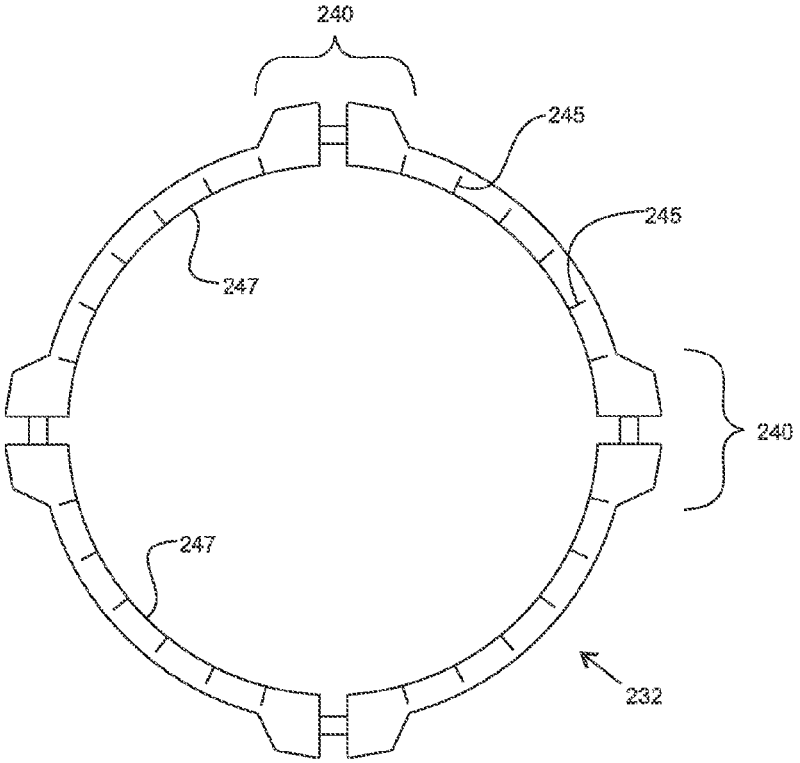
FIG. 4 is a top view of a four-piece hoop having four closures, preferably selected from those of the present invention.

One closure is often sufficient for a hoop. Nonetheless, in hoop embodiments of the present invention, there may be more than one split; and each further split may have an associated closure of the present invention or of a kind in the prior art. FIG. 4 is a top/plan view of a circular hoop 232 comprising four closures 240 which join together four quarter-segments 247 of the hoop. Fewer or more than four closures may be used in other embodiments. FIG. 4 also shows indicia 245 which are on the surface of hoop 232. Such indicia may be present on hoops of other embodiments described herein. Having multiple splits and associated closures may be seen as providing the desired change in bore diameter in a way which better maintains the circularity (in this example of a round hoop) and which applies force somewhat more uniformly, compared to having one closure. Having multiple closures also may enable a hoop to accommodate a greater change in bore dimension than is achievable with one closure. Having more than one closure can also better serve the objects of the invention when the hoop is non-circular. A hoop having multiple splits may comprise two or more different kinds of closures and/or varying length segments.

Figure 5:
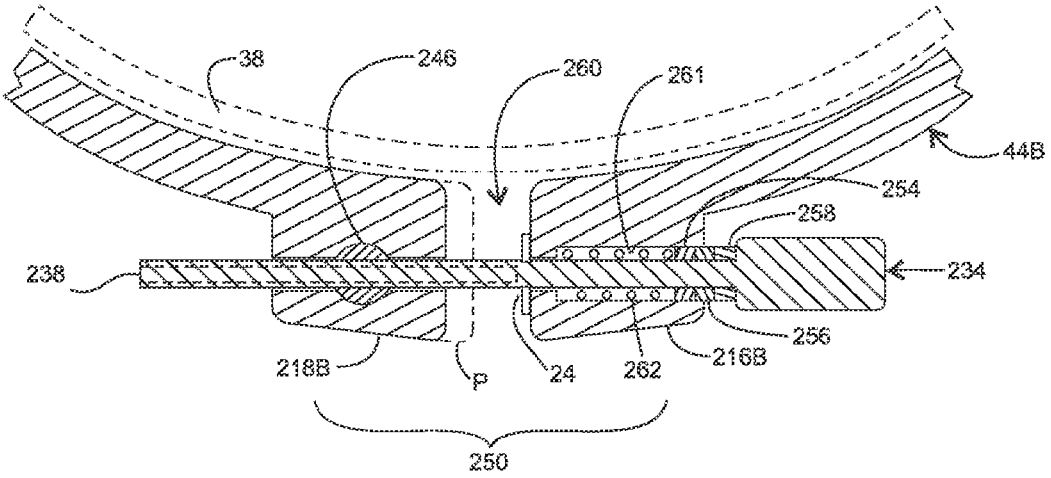
FIG. 5 is a partial plan view cross section of a hoop, showing the split region of an outer hoop having a closure which comprises a rotatable rod that changes the compression of a spring captured in a bore hole of the hoop buttress.
Figure 6:
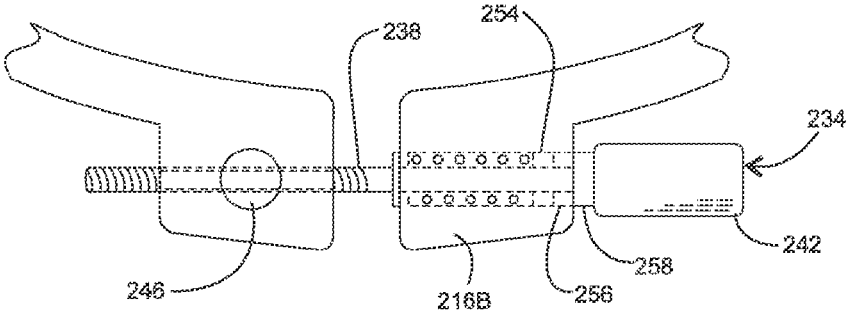
FIG. 6 is a partial plan view of the outer hoop shown in FIG. 5.
Figure 7:
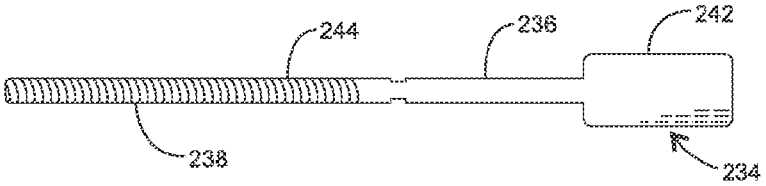
FIG. 7 is a side view showing the threaded rod used in the hoop shown in FIG. 5.
Figure 8:
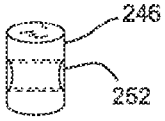
FIG. 8 is a perspective view of the barrel nut of the hoop shown in FIG. 5.
Figure 8A:
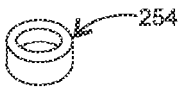
FIG. 8A is a perspective view of one of several sleeves that are positioned along the shaft of the rod in the device shown in FIG. 5.

FIG. 5 shows in planar cross section a portion of hoop embodiment 44B. FIG. 6 is a top view of the same structure as shown in FIG. 5. The two Figures show the closure 250 and adjacent hoop portions. FIG. 7 to FIG. 8A show parts of the closure 250. The opposing side buttresses 218B, 216B of hoop 44B are connected by rod 234. A male threaded shaft 238 of rod 234 runs through a threaded hole in barrel nut 246 which is captured within buttress 218B. Barrel nut 246 is a cylinder having a threaded hole running transverse to the cylinder length. Rod 234 has a knob 242 which is suited for manual turning. The preferably plain portion 236 of the shaft of rod 234 passes through a coil spring 262 which is captured within a bore hole 261 in buttress 216B. An E-ring 24 fits onto groove 244 of rod 234 so that rod 234 and spring 262 are captured within buttress 216B.

When rod 234 is turned in the appropriate direction, it will draw the buttress 218B towards the buttress 216B, as indicated by the phantom P of buttress 218B, reducing the dimension of gap 260. For any particular location of rod 234 within barrel nut 246, the outer hoop is able to expand when the inner hoop and outer hoop are engaged with each other to capture fabric, since the coil spring 262 will compress and the rod 234 is slidingly and rotatably journaled in the buttress 216B. While various springs, such as spring 262, are described here as preferably being contained within a buttress, it will be evident that a buttress can be made smaller (or a shaft longer) and a spring may be exposed. For appearance and protection from dirt and fibers, it is preferred to have a spring contained within a buttress or other protection.

Thus the initial diameter of the hoop 44B, before it is engaged with an inner hoop to capture fabric, can be preset by adjustment of rod 234. As shown in FIG. 5, closure 250 preferably comprises three small sleeves 254, 256, 258 which are mounted on portion 236 of the shaft of rod 234. A typical sleeve 254 is shown in FIG. 8A. The sleeves are located between the inner end of the knob 242 and the coil spring 262. Each sleeve has a dimension which is slightly smaller than the bore hole 261 in the buttress. Thus when spring 262 is compressed sufficiently, as by increased separation of the buttresses, one or more sleeves will enter the bore hole 261. Thus the user has a quick visual indication of the amount of compression of the spring, and therefore the amount of force which the outer hoop is applying to the fabric which runs across the inner hoop. From records or memory, the user will know whether she has adjusted the rod correctly for good and consistent performance in subsequent embroidery cycles.

The top view in FIG. 6 shows two of the three sleeves are within the bore, and thus not visible to the operator. One sleeve is visible and provides an operator with a discrete visual indication of how much the coil spring 262 has been compressed—and as a corollary, how much force is applied to the fabric after a fabric-carrying inner hoop is pressed into the bore of the hoop 44B. Fewer or more sleeves may be used in carrying out this aspect of the invention.

Tracking how many sleeves are within or outside the bore is enhanced when the sleeves are differently colored. Thus an operator, seeing for instance a red sleeve 256 and a blue sleeve 258 and not a green sleeve 254, will quickly "read" the setting of the rod. This will ease and expedite reproduction of prior settings, and the setting of like-hoops to the same settings. Sleeves may be differentiated from each other by means other than color, for example, by texture or finish including dots, lines, etc., by length/size, etc.

Figure 9:
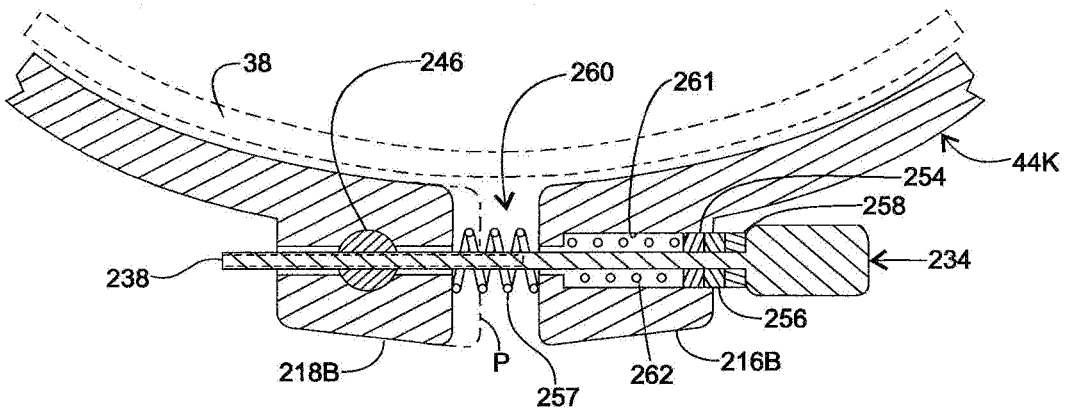
FIG. 9 is a view of a device like that of FIG. 5, showing in addition a spring in the gap region.

FIG. 9 shows a portion of a hoop 44K, an embodiment which has a closure comprised of features which are like those of hoop 44A shown in FIG. 5, but for the elimination of the E-ring 24 and the addition of the spring 257 which circumscribes the rod 234 where it runs in the gap 260 between the buttresses. It will be appreciated that the E-ring serves to pull the buttress 216B away from the buttress 218B when rod 234 is turned to increase the dimension of the gap in the FIG. 5 embodiment. Spring 257 serves the same function for hoop 44K.

Figure 10:
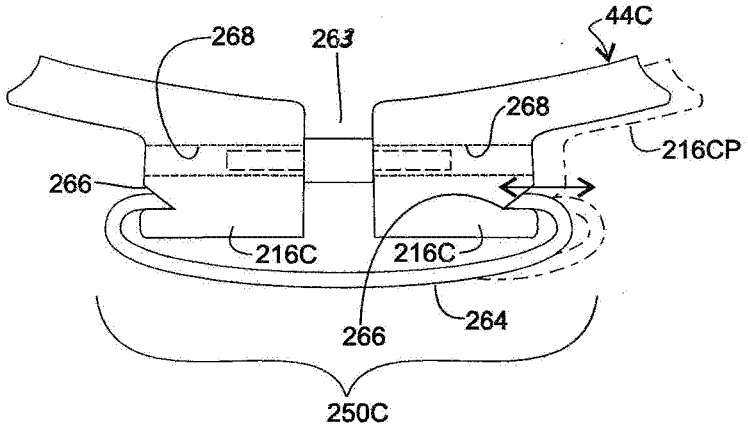
FIG. 10 is a partial plan view of an outer hoop, showing a closure which comprises a slip-fit guide pin running between the opposing buttresses in combination with a C-shape spring clip.
Figure 11:
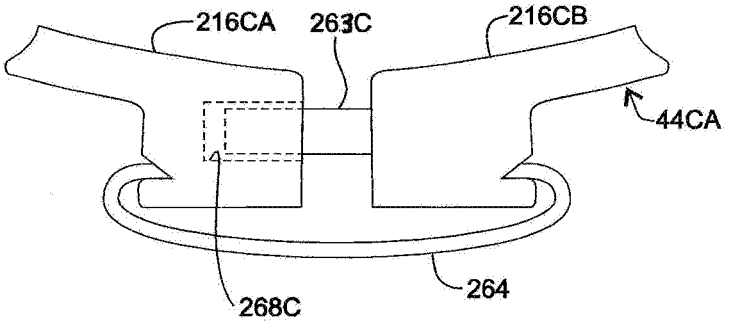
FIG. 11 is a view like that of FIG. 10, showing a variation on the FIG. 10 hoop where a guide pin is fastened within one buttress.

FIG. 10 shows a portion of another embodiment of outer hoop 44C having closure 250C. C-shape flat spring 264 spans the gap between opposing buttresses 216C, and the ends of the springs are set within grooves 266 on opposing exterior sides of the buttresses. Alternatively, a coil spring or rubber band may be used in place of spring 264. Hoop 44C can expand in diameter, as it is being engaged with an inner hoop and associated fabric. This is illustrated by the phantom 216CP of buttress and spring-end, and the double-headed arrow. Preferably, pin 263 is slidingly positioned within bore holes 268 of the identical buttresses 216C, to help keep them aligned. FIG. 11 shows a variation, namely hoop 44CA in which pin 263 is integral with one buttress 216CB and slip-fits within bore hole 268C of the other buttress 216CA.

Figure 12:
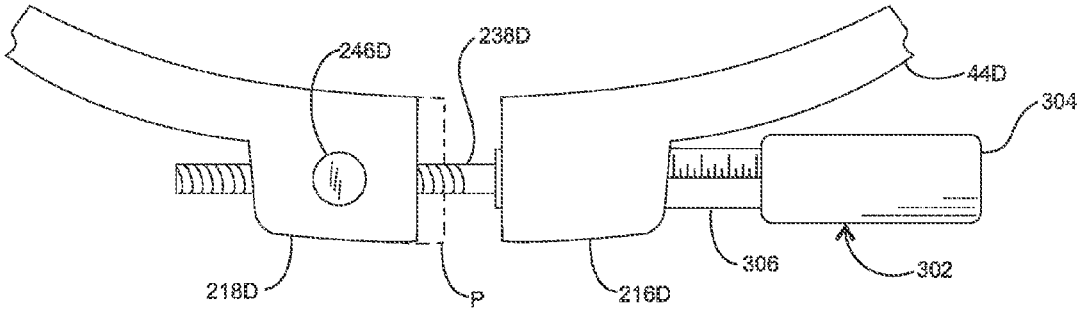
FIG. 12 is a partial top or plan view of an outer hoop having a closure which comprises a threaded rod with knob and barrel, of the type familiar in hand micrometers.
Figure 13:
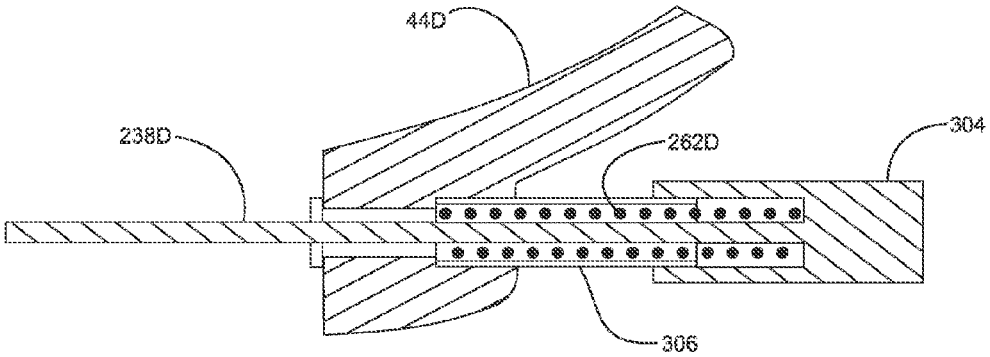
FIG. 13 is a partial cross section of the closure of the split hoop shown in FIG. 12.

FIG. 12 shows another embodiment, hoop 44D, which has a configuration similar to the hoop of FIG. 6, but where the adjustment of the hoop is accomplished by a tube and barrel combination. The construction is much like that of a common hand micrometer. FIG. 13 is a partial cross section of one buttress and the rod of hoop 44D. Hoop 44D has a shaft 238D, the outer threaded end of which is engaged with a threaded hole in barrel nut 246D, like the construction previously described. Rotation of knob 304 turns the shaft/screw to which it is connected; and thus causes buttress 218D to move to or from vicinity of buttress 216D, as indicated by phantom P. The gap between the buttresses is adjustable and pre-settable by the operator visually noting where is the location of the edge of knob 304 along the length of indicia on the barrel 306 which is fixed to buttress 216D. During use, spring 262D is compressed, consistent with the operation of hoop 44B, described above.

FIG. 14 to FIG. 22 illustrate embodiments of the invention which comprise gauge means, namely device features which provide alternative visual indicators of the amount of gap between the buttresses of a split-hoop or the amount of spring force which is being applied to the hoop in its use position, according to the configuration of the closure. The gauge means are of two types: First, a bar spans the gap. Second, the extension of the threaded shaft of a closure from a buttress is indicated. The gauge means inventions which are described below may be used in combination with the closures described above, as well as with prior art closures, including closures of the type shown in FIG. 1. Closures having gauge bars may also be used with hoops which are non-circular in shape.

Figure 14:
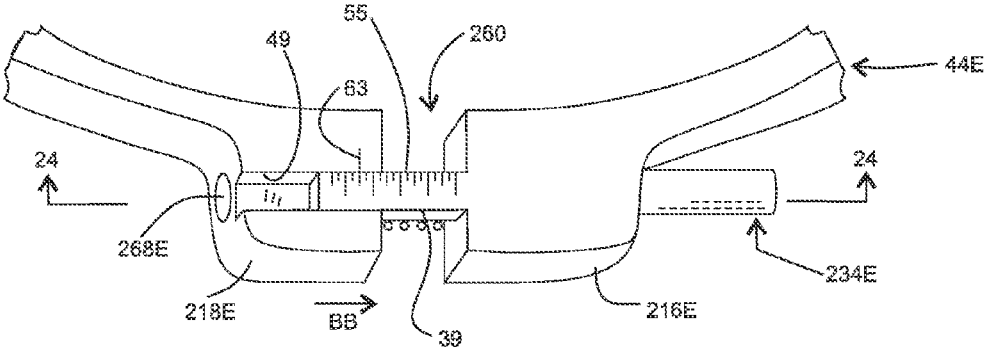
FIG. 14 is a perspective view of a portion of an embodiment of split hoop, showing a closure comprising a gauge bar which spans the gap of the hoop.
Figure 15:
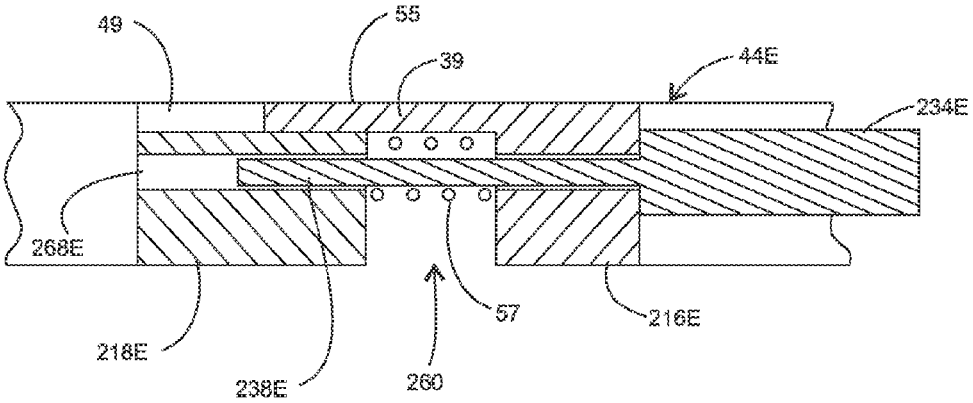
FIG. 15 is a partial vertical cross section of the hoop shown in FIG. 14.

FIG. 14 is a perspective view of a portion of split outer hoop 44E having a gap 260 and associated closure. FIG. 15 is a vertical cross section through the hoop 44E shown in FIG. 14. The closure of hoop 44E comprises a rod 234E which runs slip-fit through a hole in buttress 216E, and threadingly engages a threaded hole 268E in buttress 218E. (Alternatively, a barrel nut like that of FIG. 5 may be substituted for the threaded hole.) Spring 57 is captured around the shaft 238E of rod 234E, in the gap space 260. When rod 234E is suitably turned to draw the buttresses together as indicated by arrow BB, the coil spring 57 is compressed. When the rod 234E is turned to open the gap, spring 57 pushes buttress 216E away from buttress 218E. Alternatively, the device shown in FIG. 15 may be modified to omit spring 57, and to use instead an E-ring. See the embodiment 44G in FIG. 18.

Referring again to FIG. 14-15, bar 39, which has indicia on a top surface 55 thereby making it a gauge bar, extends in cantilever fashion from the top of buttress 216E and rides in groove 39 of buttress 218E, as a rest. The indicia delineate increments of length. A printed, etched or embossed line 63 or other indicator on the surface of buttress 218E indicates the location of end of bar 39 along the length of the groove and thus provides a measurement of the width of the gap between the buttresses. In this and other embodiments, the gauge bar may be integral with the buttress or may be a separately formed element which is fastened to one buttress or alternatively an adjacent section of the hoop. And, while one cantilever gauge bar is described for certain embodiments, in the generality of the invention there may be alternatively two cantilever gauge bars, one extending from each side of the split in the hoop.

It will be appreciated that hoop 44E and other hoops having a spring around the shaft where it runs in the gap will function differently from the hoops such as hoop 44B, where the spring is compressed if engagement of an inner hoop with an outer hoop applies sufficient force to the bore of the outer hoop. In hoop 44E, the function of the spring is to keep the buttresses apart. The buttresses cannot move apart further than the preset adjustment of the rod allows.

Figure 16:
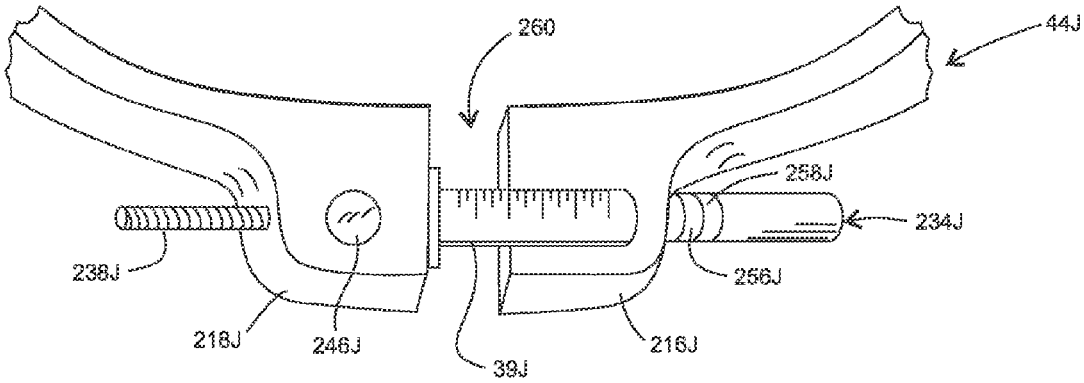
FIG. 16 is a perspective view of a portion of an embodiment of split hoop, showing a gauge bar spanning the gap above the place where the adjustment rod runs between buttresses.

FIG. 16 is a perspective view of a portion of a split hoop embodiment 44J, showing the split region of the hoop. The hoop has a rod and spring like that of the device in FIG. 5, and further comprises a gauge bar which spans the gap of the split. More particularly, the opposing side buttresses 218J, 216J of hoop 44J are connected by the threaded shaft 238J of manually-rotatable rod 234J, which passes through a threaded hole within barrel nut 246J of buttress 218J. Indicator-sleeves 256J, 258J are on the threaded shaft. See the description of FIG. 5, above, for more details about the sleeves and internal spring, not shown in FIG. 16. Gauge bar 39J is affixed to the gap-facing surface of buttress 218J and spans the gap 260 and beyond. A user can gauge the dimension of the gap by observing the alignment of the gauge markings with the gap-edge of buttress 216J.

Figure 17:
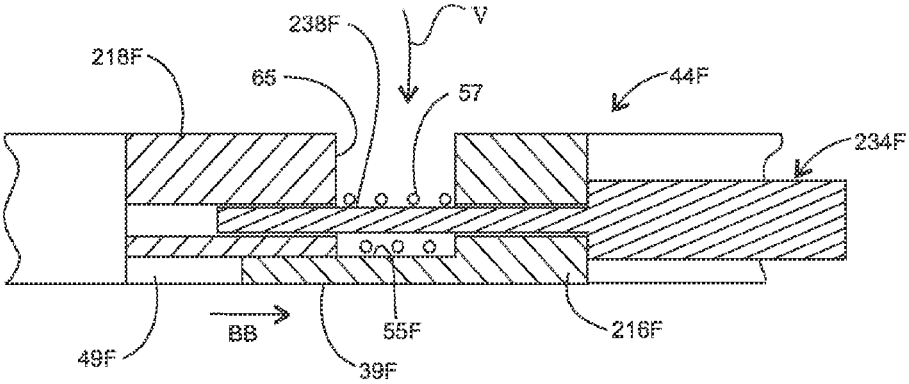
FIG. 17 is a partial elevation cross section of a hoop showing the split region and a gauge bar which spans the gap and runs beneath the rod of the closure.

FIG. 17 is a vertical cross section view of an alternate embodiment hoop 44F which has a gauge bar 39F that extends from buttress 216F and slides in groove 49F on the underside of buttress 218F as indicated by arrow BB. Rod 234F, spring 57 and rod shaft 238F are configured and function as described above. An operator can view indicia on the upper surface 55F of the gauge bar and thus the location of the edge 65 of buttress 218F along the gauge bar, looking from a viewpoint illustrated by arrow V.

Figure 18:
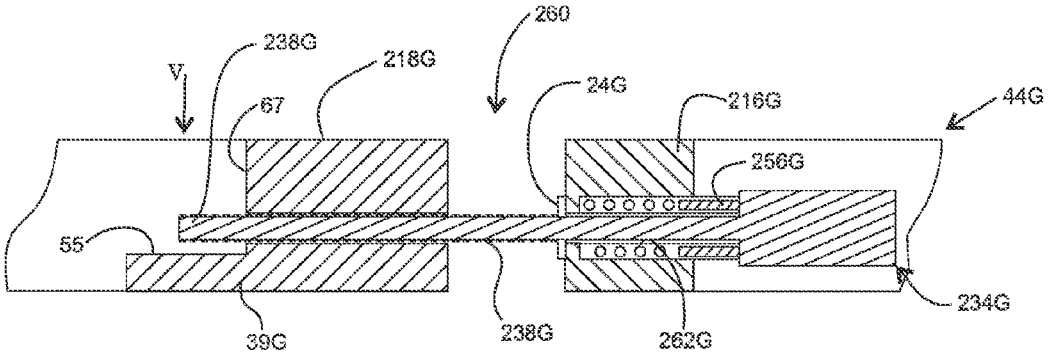
FIG. 18 is a partial elevation cross section of a hoop embodiment, showing the split region, and a gauge bar that underlies the outer end of the rod of the closure.
Figure 19:
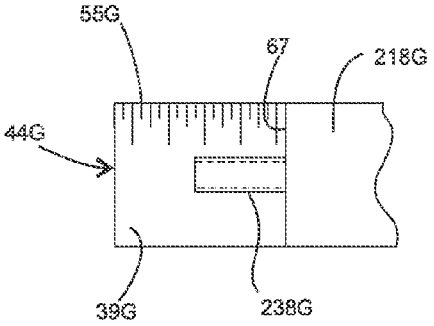
FIG. 19 is a partial top view of hoop shown in FIG. 18, showing the gauge with indicia at the rod end.

FIG. 18 is a vertical cross section view of hoop embodiment 44G having another kind of gauge for indicating the preset gap of the hoop. FIG. 19 is a top view of a portion of the hoop 44G shown in FIG. 18. The closure of hoop 44G functions similarly to that described in connection with FIG. 5. Rod 234G captures a sleeve 256G and coil spring 262G within the bore of a hole in buttress 216G. E-ring 24G keeps the rod in place in buttress 216G. The threaded shaft 238G of the rod engages a threaded hole in buttress 218G. The shaft 238G is long enough so its end extends beyond the outer vertical edge 67 of buttress 218G. Bar 39G also extends from the edge 67 of the buttress and has indicia on surface 55C, such as embossed, printed or etched marks indicating increments of length, thereby making it into a gauge bar. Thus a user can view the gauge bar as indicated by arrow V in FIG. 18 and see the location of the end of shaft 238G of rod 234G. Thus, the user is given a visual measure of the gap 260 between the buttresses.

Figure 20:
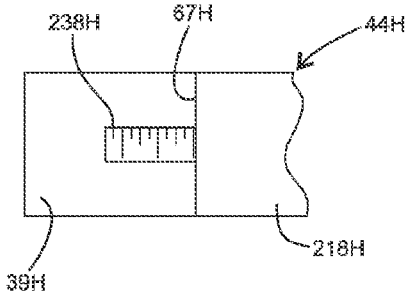
FIG. 20 is a partial top view of hoop, similar to the view of FIG. 19, showing a gauge which is integral with the shaft of the closure rod.

FIG. 20 is a view like that of FIG. 19, showing a variation of hoop 44G. In alternate embodiment hoop 44H, the end of rod 238H extends beyond the edge 67H of buttress 218H, like the rod in FIG. 18. In hoop 44H, the end of the rod has indicia, so that the user can visually determine how much of the rod is exposed, and thereby be provided with information about the size of the gap. The bar 39H may be present to protect the end of rod 238H from damage or may be omitted in this embodiment.

Figure 21:
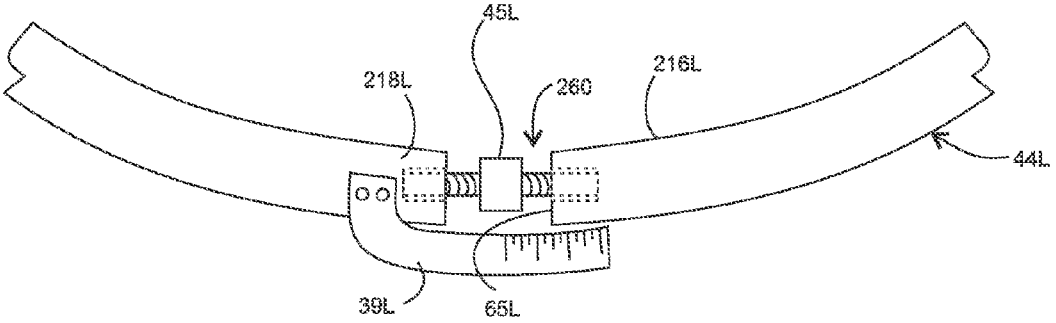
FIG. 21 is a partial top view of a split hoop having a gauge bar and adjusting screw.

Gauge bars may be used with split hoops which do not have buttresses. FIG. 21 is a partial top view of split hoop 44L which has a closure comprising gauge bar 39L and adjusting screw 45L. gauge bar 39L is staked to the end 218L of the hoop and extends across the gap 260. Screw 45L is of the kind used in the prior art, with opposing end different-hand screws. Turning of the screw in one direction increases the size of the gap. The dimension of the gap is indicated by viewing where edge 65L of the end 216L of the hoop lies with respect to the indicia on gauge bar 39L.

Figure 22:
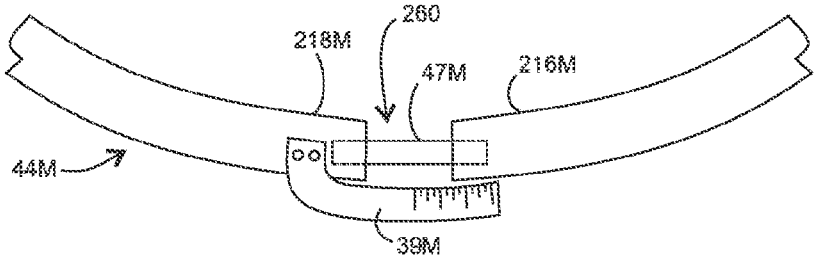
FIG. 22 is a partial top view of a split hoop having a gauge bar and elastomer tensile member connecting the split ends of the hoop.

FIG. 22 is a partial top view of split hoop 44M which has a gauge bar 39M that is staked to the end 218M of the hoop. The closure of hoop 44M comprises split ends of the hoop connected to each other by an elastic tether 47M. The elastic tether may be a piece of sturdy elastomer that is molded or mechanically captured in each of opposing split end of the hoop. For example, a bungee cord may be used. Tether 47M exerts tensile pulling force on the ends 216M, 218M of the hoop as the size of the gap increases when the hoop is forced over an inner hoop. Gauge bar 39M extends across the gap and beyond, as shown. The dimension of the gap is displayed by the location of the edge of end 216M relative to indicia on the gauge bar.

Fixtures

Figure 23:
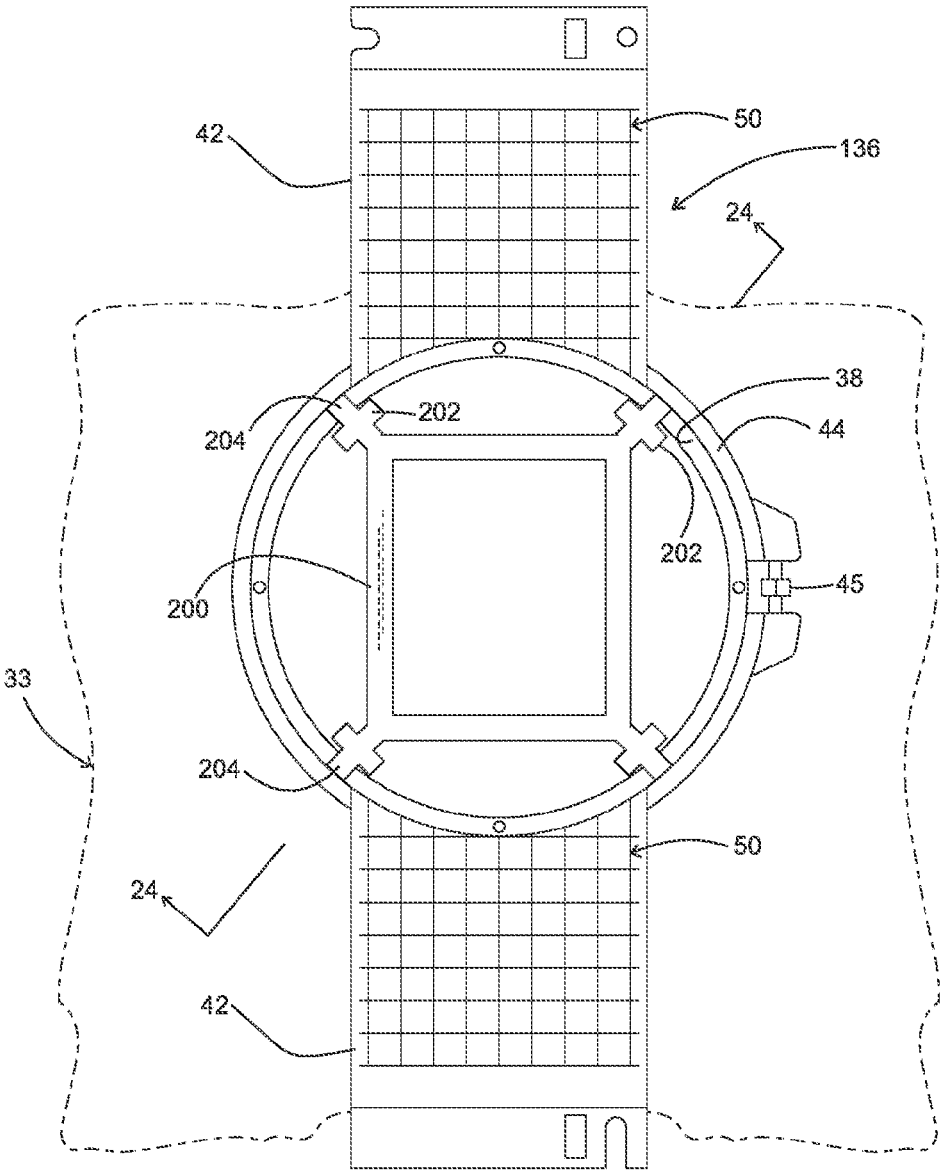
FIG. 23 is a view like FIG. 1, showing a fixture of the present invention positioned for holding a sub-element of fabric within the bore of the inner hoop of a hoop assembly.

FIG. 23 is a top view like FIG. 1, and shows apparatus 136 which includes a device 36 of FIG. 1 in combination with fixture 200, which is mounted within the opening of inner hoop 38. The fixture 200, shown in simplified fashion in FIG. 23, is used for holding a sub-element of a garment, for example, a badge, an emblem, a pocket portion of a shirt, or for holding a belt or strap or something else which may be wanted as part of a finished fabric product.

Fixture 200 is removably mounted as part of assembly 136, preferably by use of one of the mounting means which are described below. A fixture of the type 200 may also be used to hold an article which is not intended for incorporation as part of a larger article but which is too small or poorly shaped for holding within an inner hoop and outer hoop. Some embodiments of the present invention show how a fixture is received and retained within the inner hoop 38 of the device 36. In FIG. 24 to FIG. 27, different embodiments of fixtures 200 are shown as indicated by the suffixes to the number 200. In most instances, the drawings of fixtures are simplified for clarity of illustration. Fixtures will typically be made of metal but may be made of other material. Other fixtures are described in connection with FIG. 28 to FIG. 32.

Figure 24:
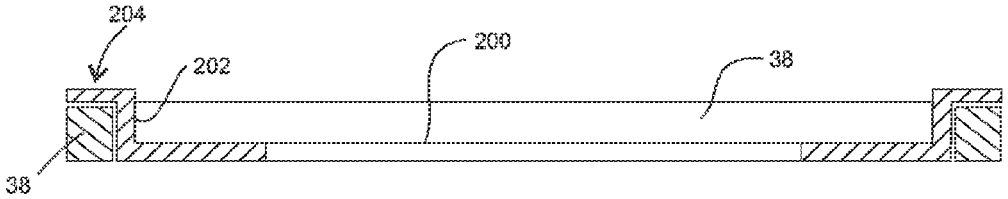
FIG. 24 is a partial vertical cross section through the assembly of FIG. 23, showing how the fixture is mounted on the inner hoop.
Figure 25:
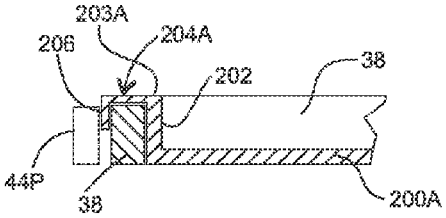
FIG. 25 is a partial vertical cross section like that of FIG. 24, showing a fixture having spring-like tabs for engaging and holding onto the inner hoop.
Figure 25A:
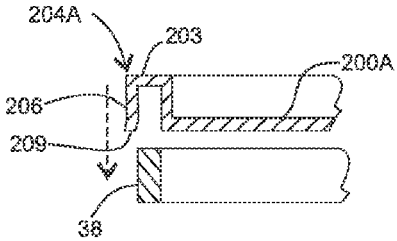
FIG. 25A is a partial vertical cross section view of the assembly shown in FIG. 25, showing how fixture and inner hoop approach and engage each other.
Figure 26:
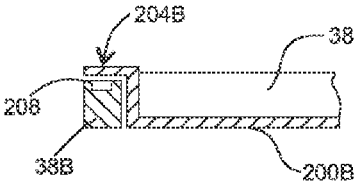
FIG. 26 is a view like that of FIG. 25, showing a metal fixture having tabs which hold the fixture in place by being attracted to magnets embedded in the structure of the inner hoop.
Figure 27:
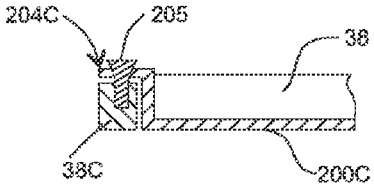
FIG. 27 is a view like that of FIG. 25, showing a fixture having tabs which are held in place by screws running into the structure of the inner hoop.

FIG. 24 is a vertical cross section of the apparatus of FIG. 23. Fixture 200 has tabs 204 which comprise vertical running portions, namely guides 202 that centralize the fixture within the bore of the inner hoop 38, and horizontally running portions, namely flats 203 as shown in FIG. 25A that rest on the top surface of the hoop 38 to hold the fixture vertically in place, against gravity. FIG. 25 to FIG. 27 are similar and show different embodiments 200A, 200B and 200C of the invention, aimed at better holding a fixture in place during use.

First, it will be appreciated that it may often be desirable to place the sub-element within a fixture 200 before the fixture is put in its working location within the opening of an inner hoop. Often, it may be desirable to remove the fixture from its working location within the fabric holding device 36, rather than remove the whole of the device 36 from the embroidery machine with the fixture in place. A user may employ multiple fixtures like fixture 200. Thus, while the embroidery machine is working on a first sub-element held in place on a device 36 by a first fixture, the operator can load a second sub-element into a second fixture, so the second fixture can be quickly placed on the device 36 after the first article is finished and first fixture has been removed. When an operator is handling a multiplicity of embroidering machines, the ability quickly to change fixtures can be a large time saver.

Thus, in the present invention a fixture is easily removable and quickly and accurately inserted/positioned onto the inner hoop. However, if a fixture rests simply on the top edge of the inner hoop as shown in FIG. 4, the fixture might rotate with respect to the inner hoop due to vibration associated with operation of the embroidery machine, which could result in the sub-element being misaligned with the underlying fabric or garment and/or misaligned embroidery. Also, vibration of the embroidery machine or operator mistake can cause the fixture to lift upwardly. In the improvements of the present invention, the fixture remains more securely in place during embroidering, yet the fixture may be quickly and conveniently removed from its working location on a device 36. The configuration of fixture and the associated mounting means described herein help achieve the aims of quick-change and consistent and stable positioning.

FIG. 25 shows an embodiment of fixture 200A with a ring/hoop. The tabs 204A of fixture 200A have flats with lips 206 which extend vertically down. The tabs are preferably made of spring steel or other elastic material. The spacing between the lips 206 and the vertical guide 202 portion of the fixture is made small relative to the thickness of ring 38, so that the lips 206 spring outwardly when the fixture is engaged with the top edge of ring 38. The engagement of the fixture with the hoop may be eased by a slight cant portion 209 at the bottom of the lip 206, as shown in FIG. 25A, where the approach of the fixture to the ring is illustrated. Thus, when the fixture is in place, the vertical upward motion of the fixture relative to the ring will be resisted by frictional engagement of the fixture with the ring 38. At the same time, when the operator wishes manually to remove the fixture, she can easily apply sufficient force to overcome the frictional engagement and to pull the fixture vertically away from the hoop.

FIG. 26 shows another embodiment wherein fixture 200B, or at least each tab, is made of magnetic material such as steel. By magnetic material is meant a material which is attracted to a common permanent magnet. Permanent magnets 208 are embedded within the structure of the inner ring 38B at one or more locations, preferably at four locations and preferably as pairs of magnets at each location. The magnets hold the fixture in place, resisting any jostling that might occur during the running motions of the embroidery machine. Yet, the fixture can be easily and quickly removed by the operator applying sufficient vertical force to overcome the magnetic attraction force. In an alternate less preferred embodiment, not shown, the tab-engagement features, e.g., magnets, may be incorporated in the outer hoop instead of the inner hoop, particularly when no fabric is being held between the hoops. The tabs of such alternative fixture will have sufficient dimension to extend radially to the location of the outer hoop. In another way of the carrying out the invention, magnets may be attached to or embedded in the fixture and the inner hoop 38 (or outer hoop) is locally or wholly made of magnetic material.

FIG. 27 is a view like that of FIG. 25, showing fixture 200 with a hoop. The tabs 204C of fixture 200C have through-holes or slotted holes and thus the fixture 200C is held in place by means of screws 205 which engage into threaded holes in the inner ring 38C. This embodiment might be useful when the fixture is left in place during embroidering of multiple articles, for example where the fixture enables change of the sub-element. See the description associated with FIG. 29.

Figure 33:
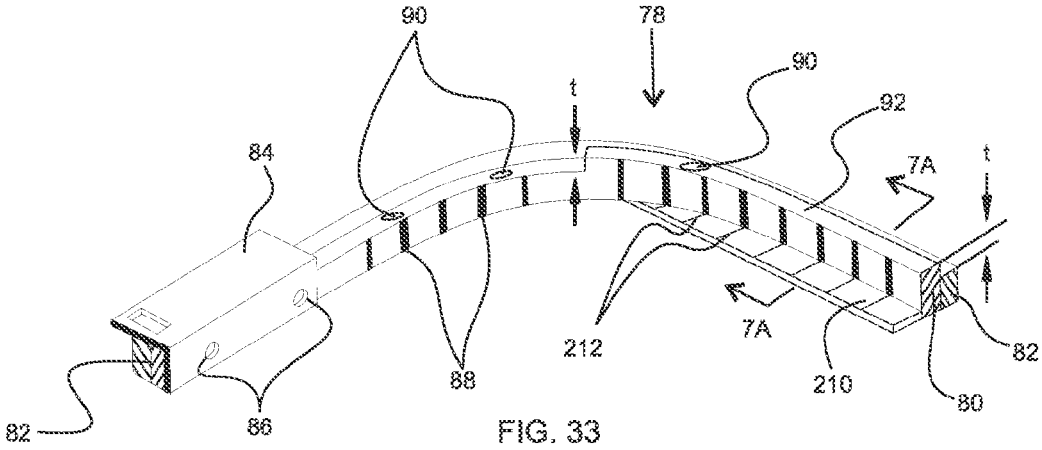
FIG. 33 is a perspective view of a portion of a rectangular inner and outer hoop assembly, where the inner hoop has a ledge with upward-facing indicia.

FIG. 33 is a partial view of an oblong or nominally rectangular ring 78 that will be used in substitution of a round ring 38, when the size of the embroidery or the size/nature of the article dictates the need for such. Such other shapes of rings are known in the art, and include nominally square and oval rings.

Figure 34:
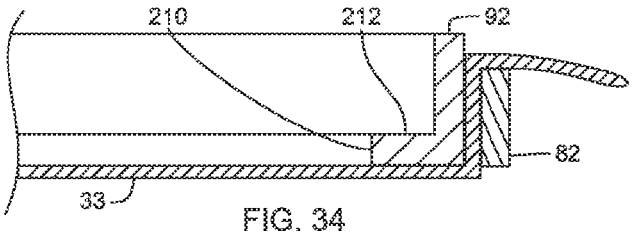
FIG. 34 is a fragmentary vertical cross section of the assembly shown in FIG. 33, now showing fabric which is captured between the hoops.

In accord with U.S. Pat. No. 6,298,800, there are indicia 88 within the bore of the ring 78, as shown in FIG. 33. FIG. 34 is view like that of FIG. 2. In particular, it is a cross section through the hoop and ring of FIG. 33, now showing a piece of fabric 33 captured between the rings. A small shelf or ledge 210 extends laterally into the opening within the ring 78 at the bottom of the ring. It is seen that the fabric is in contact with, or very close to, the underside of the ledge 210. The ledge has upwardly facing indicia 212, thus providing improved visibility to an operator of a desired alignment of the hoop with the orientation of fabric captured within the hoop opening.

Figure 28:
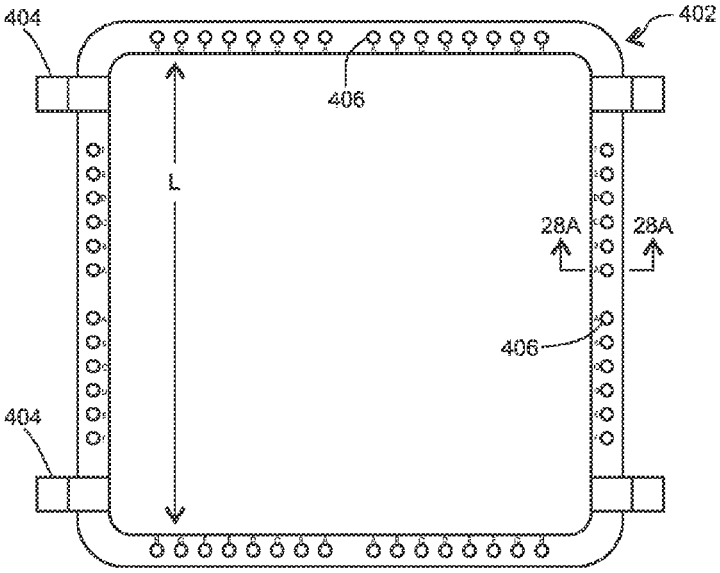
FIG. 28 is a planar view of a rectangular support used in the fixture assembly shown in FIG. 29.
Figure 28A:
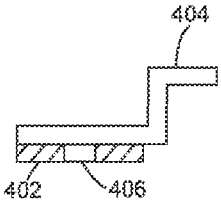
FIG. 28A is a cross section through the tab location of the support shown in FIG. 28.
Figure 29:
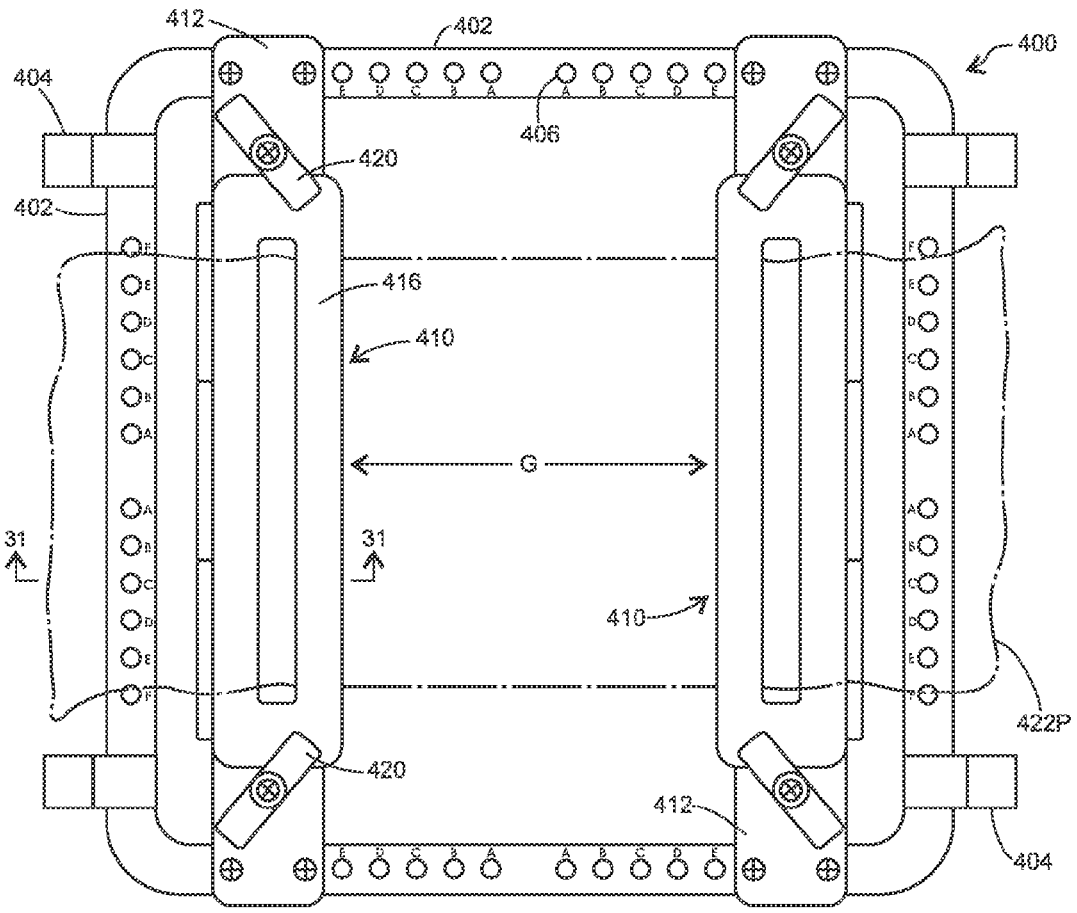
FIG. 29 is a planar view of a fixture assembly used for holding a sub-element within the opening of a rectangular shape inner hoop, not shown.
Figure 30:
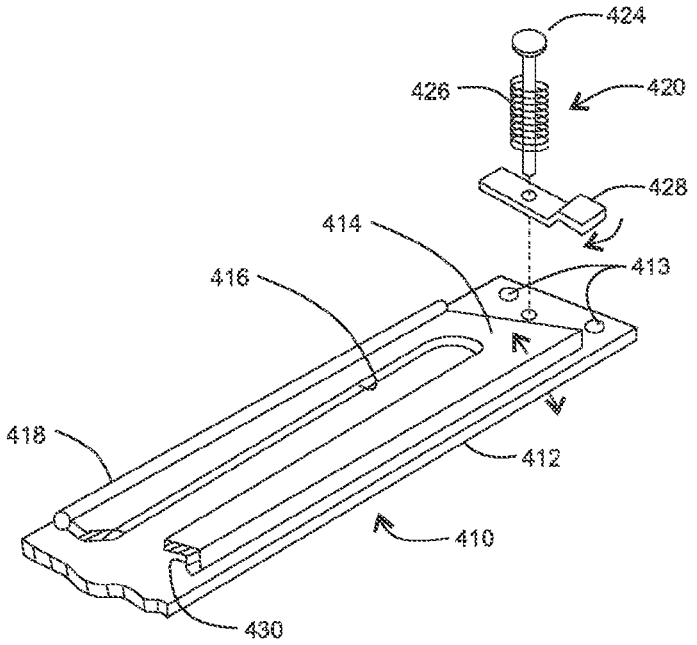
FIG. 30 is a perspective cut-away view of one of the rail assemblies used in the apparatus shown in FIG. 29.
Figure 31:
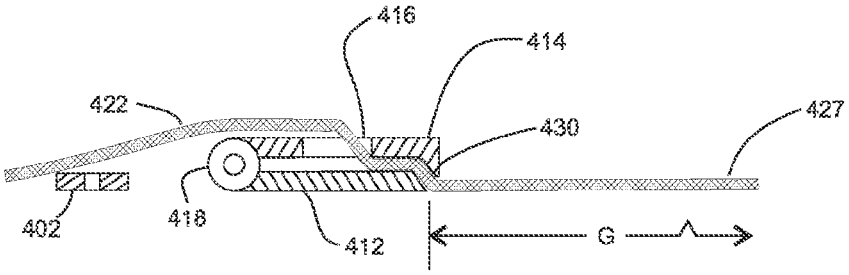
FIG. 31 is a partial cross section elevation view of the apparatus shown in FIG. 29, along with a fabric sub-element that is captured in one of the rail assemblies.
Figure 32:
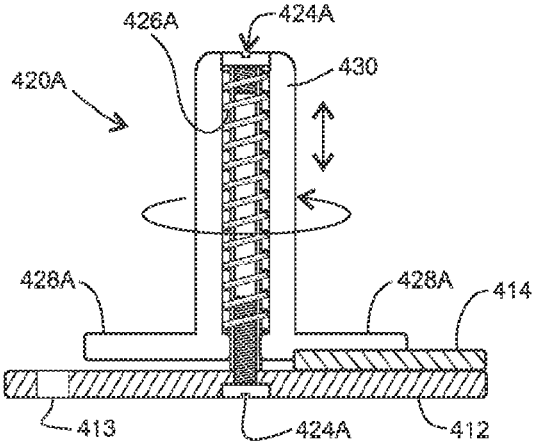
FIG. 32 is a cross section elevation view of a hold-down which is useful in the rail assembly shown in FIG. 30.

FIG. 28 is a plan view of a support bracket 402 which is part of the fixture assembly 400 shown in FIG. 29. FIG. 28A is an elevation cross section view of part of support bracket 402. FIG. 30 is partial perspective view of one of the two similar rail assemblies 410 shown in FIG. 29. The rails hold a sub-element within the opening of a hoop when the fixture 400 is appropriately mounted on a hoop. FIG. 31 is a vertical cross section through the assembly of FIG. 29. FIG. 32 is a preferred embodiment of hold-down 420A, useful in the rail assemblies of FIG. 29 in substitution of simple hold-down 420.

Referring to FIG. 28 and FIG. 29, support bracket 402 of assembly 400 has mounting features, namely four tabs 404 for resting on the upper surface of a rectangular shape inner hoop, not shown. The mounting feature tabs of the support bracket 402 may be selected from those described above in connection with the fixtures 200 shown in FIG. 24 to FIG. 27. The cross section of FIG. 28A shows typical tab 404 which is attached to the support bracket 402. In an alternate embodiment not shown, the tabs may be located at the corners of the support bracket, as shown in FIG. 23, so the assembly 400 may be used with a circular inner hoop.

The assembly 400 comprises two rail assemblies 410 which have lengths running parallel to length L of the support bracket. Each rail assembly 410 is preferably identical and comprises a rail base 412 and a hinged cover 414. Support bracket 402 preferably has a series of spaced apart holes 406 for receiving bolts or screws which affix the ends of each rail base 412 to the support bracket. In alternative embodiments not shown, slots may be used instead of holes; or the rail assemblies may be secured to the support bracket by use of rivets, pins, welds or other suitable means.

The plan view of FIG. 29 shows support bracket 402 with two attached rail assemblies 410, for clamping fabric. Rail assemblies 410 are spaced apart an adjustable distance G from each other. In use, a piece of fabric 422P, shown in phantom, runs between the rail assemblies; the fabric is held taut within the gap G so it may be embroidered upon or otherwise processed in an embroidery machine. FIG. 31 shows how sub-element fabric 422 is captured within a rail assembly when the cover 414 is closed and clamped in place.

A portion of a typical rail assembly 410 is shown in the cutaway perspective view of FIG. 30. The base 412 of a rail assembly 410 has holes 413 at each end, for passage of screws and attachment to support bracket 402 as shown in FIG. 29. Cover 414, which also functions as a clamp for fabric, is hingedly attached to the base 412 by hinge 418. Cover 414 and has a lengthwise slot 416. A simple hold-down latch 420 is located at each end of the rail assembly. The hold-down latch 420 comprises a headed-pin 424 which is fastened to the base 412, capturing a spring 426 which presses downwardly on rotatable tab 428. When tab 428 is turned onto the cover 414, the spring force presses the cover downwardly toward the top surface of base 412.

FIG. 31 shows cover 414 pushed down onto fabric 422 which runs from gap G, across the inner edge of base 412, through cover slot 416, across the hinge side of cover 414, and across the top of support bracket 402. As FIG. 31 illustrates, the downward extending lip 430 at the outer edge of cover 414 presses fabric 422 against the upper surface of the edge of base 412, thus capturing securely fabric 422, so it runs in desired taut fashion across the gap G.

FIG. 32 shows a preferred embodiment of hold-down latch 420A as it is mounted on a rail assembly, when viewed transverse to the length of the rail base 412. Body 430 of the hold-down latch is attached to the rail base 412 by pin 424A. The pin is circumscribed by spring 426A which is contained within the bore of the body. The body has opposing laterally extending tabs 428A. The spring presses the body downwardly, while allowing the body to be lifted upwardly and rotated by an operator who overcomes the spring force. In use, after inserting the fabric of the sub-element as described above, an operator will lift the latch body upwardly so the elevation of the underside of a tab 428A can be rotated onto the top of cover 414 which then lies nearly parallel with the top surface of the base 412. When the operator releases the upward force on the latch, the force of captured spring 426A presses the latch body, and thus a tab 482A, downwardly onto the flat-folded cover 414, so the fabric is firmly held, as has been described. In another embodiment of the invention, each base has only one latch.

In an alternate embodiment, a latch may lack springs and the spacing between the underside of a tab of the latch—and the top surface of the rail base 412 may be sufficiently close to achieve the goal of holding down the cover against the resisting force of a compressible-substance sub-element. In another embodiment, there is also no internal (coil) spring, and the tab of a latch down may have inherent springy-ness; for example it may be a strong elastic material.

While having rail assemblies mounted on a removable support provides the advantage of quickly exchanging one fixture assembly 400 for another pre-loaded fixture assembly 400, in the generality of this aspect of the invention, there is no support bracket 402, and rail assemblies of the type exemplified by assemblies 410 may be directly mounted on or attached to the surface of a hoop. While the preferred springs which have been described are made of coiled wire or flat metal strip, other resilient, elastically compressible and elastically elongatable materials may be used, such as elastomers. With respect to the claimed invention, the term spring comprehends as equivalents elastic elements different in composition of construction from the metal springs which have been described, but will be known in the art as substitutional for same.

Implicit in the foregoing descriptions are inventive methods relating to embroidering. For example, one method entails providing a multiplicity of hoops having similar construction and one of the means for displaying the compression of a spring or the size of the gap; then experimentally determining the rotational setting of a rod, to achieve a certain spring compression which is suitable for a fabric article being embroidered; noting the display of the gauge means; then setting other like hoops to the same spring compression.

Another exemplary method comprises compressing the spring of the closure of a first outer hoop by adjusting an adjustment rod so a certain number of sleeves are displayed, and then setting a plurality of like hoops so the same number of sleeves is displayed. Another exemplary method comprises ascertaining the dimension of the gap in a reference hoop when the hoop is in place to hold fabric on an inner hoop, and adjusting a plurality of other like hoops so the dimension of gap in each of the plurality of hoops is the same as that of the reference hoop.

Another exemplary method of the present invention comprises forming a multiplicity of fixtures like those described in connection with FIG. 24 through FIG. 32, placing a sub-element of fabric in a first fixture, placing the first fixture on an inner hoop so the sub-element is positioned within the bore of the inner hoop—when there may or may not be present an outer hoop and fabric captured therebetween—then, embroidering the sub-element; then removing the fixture from the inner hoop and placing a second fixture holding a second sub-element in the inner hoop and embroidering the second sub-element.

The invention, with explicit and implicit variations and advantages, has been described and illustrated with respect to several embodiments. Those embodiments should be considered illustrative and not restrictive. Any use of words which relate to the orientation of an article pictured in space are for facilitating comprehension and should not be limiting should an article be oriented differently. Any use of words such as "preferred" and variations thereof suggest a feature or combination which is desirable but which is not necessarily mandatory. Thus embodiments lacking any such preferred feature or combination may be within the scope of the claims which follow. Persons skilled in the art may make various changes in form and detail of the invention embodiments which are described, without departing from the spirit and scope of the claimed invention.

What is claimed is:

1. A hoop having a bore, at least one split, and a closure in vicinity of said at least one split, the hoop shaped for use as an outer hoop in combination with an inner hoop to hold fabric for embroidering, said at least one split enabling the dimension of the bore to change, wherein the hoop closure comprises:

a first buttress and a second buttress, said buttresses being portions of the hoop and opposing each other at the location of said split and spaced apart from each other by a gap which defines the at least one split; and, at least one spring which resiliently urges the buttresses toward each other and resists increase in the dimension of the gap; and, at least one gauge bar extending from the first buttress, spanning said gap, and overlapping the second buttress, wherein at least one of the gage bar or the second buttress in vicinity of the location of said overlapping have indicia for visually displaying the dimension of the gap.

2. A hoop having a bore, at least one split, and a closure in vicinity of said at least one split, the hoop shaped for use as an outer hoop in combination with an inner hoop to hold fabric for embroidering, said at least one split enabling the dimension of the bore to change, wherein the hoop closure comprises:

a first buttress and a second buttress, said buttresses being portions of the hoop opposing each other at the location of said split and spaced apart from each other by a gap which defines the at least one split;

at least one spring which resiliently urges the buttresses toward each other and resists increase in the dimension of the gap; and a rod journaled in the first buttress, the rod running across said gap to the second buttress, for limiting the extent to which said buttresses can separate.

3. The hoop of claim 2 wherein said at least one spring circumscribes said rod, the at least one spring compressing when the gap dimension increases due to change in dimension of the bore of the hoop.

4. The hoop of claim 3 wherein the closure comprises a second spring like said at least one spring, the second spring circumscribing said rod and at least partially contained within a bore hole of the second buttress.

5. The hoop of claim 3 wherein the closure further comprises a spacer around the shaft within the gap, to limit the extent to which the buttresses move toward each other.

6. The hoop of claim 2 wherein said rod comprises a shaft portion which in part spans the gap and a knob portion for rotation of the shaft, wherein the at least one spring circumscribes the shaft where the shaft is journaled in said first buttress; the shaft portion of the rod further having a threaded end which is received in the second buttress and engaged with a threaded hole or nut within the second buttress.

7. The hoop of claim 6 further comprising means for visually displaying the extent of at least one spring compression or the dimension of gap, the means selected from the group comprising (a) a multiplicity of adjacent sleeves around the shaft of the rod; (b) a barrel having indicia, circumscribing the shaft of the rod; (c) a gauge bar cantilevered from one buttress and extending across the gap to the second buttress; and, (d) a gauge bar integral with the second buttress and located in proximity to the end of said shaft portion which is furthest from the knob portion.

8. The hoop of claim 6 further comprising means for visually displaying the amount of at least one spring compression, said means comprising a multiplicity of adjacent sleeves around the shaft of the rod, the sleeves differentiated from each other by location along the shaft, size, color, texture, or marking.

9. The hoop of claim 8 further comprising at least one gage bar cantilevered from a buttress and running across said gap, wherein the gage bar visually displays the dimension of the gap and the sleeves visually display the extent of compression of the at least one spring.

10. The hoop of claim 6 wherein said shaft of said rod is held within the first buttress by an E-ring affixed to the shaft in vicinity of the gap.

11. The hoop of claim 6 further comprising a spring around the shaft portion which is within said gap, the spring compressing when the gap dimension is reduced by rotation of the rod.

12. The hoop of claim 6 wherein the threaded end of the rod shaft which is received in the second buttress has a portion which projects from a surface of the buttress that is spaced apart from said gap, and wherein said rod shaft projecting portion is exposed to view; further comprising a gauge located on or adjacent to said rod shaft projecting portion, for visually indicating the lengthwise location of the shaft end relative to said surface of the second buttress.

13. A hoop having a bore, at least one split, and a closure in vicinity of said at least one split, the hoop shaped for use as an outer hoop in combination with an inner hoop to hold fabric for embroidering, said at least one split enabling the dimension of the bore to change, wherein the hoop closure comprises:

a first buttress and a second buttress, said buttresses being portions of the hoop and opposing each other at the location of said at least one split and spaced apart from each other by a gap which defines the at least one split; and, at least one spring which resiliently urges the buttresses toward each other and resists increase in the dimension of the gap;

wherein said at least one spring runs from one said buttress to the other said buttress, the at least one spring being stretched and in tension when said gap dimension increases due to change in the dimension of the bore of the hoop, and wherein said at least one spring is C-shape;

further comprising a guide pin running between one said buttress and other said buttress, the guide pin slidingly journaled within one or both of the buttresses.

14. The hoop of claim 2 in combination with an inner hoop, wherein the inner hoop has integral opposing-side arms for supporting the inner hoop in an embroidery machine.

15. A hoop having a bore, a split, and opposing first buttress and second buttress, said buttresses spaced apart by a gap defining said split; the hoop shaped for use as an outer hoop in combination with an inner hoop, to hold fabric for embroidering; said split enabling the dimension of the bore to change; at least one gauge bar extending from the first buttress, spanning said gap, and overlapping the second buttress, wherein at least one of the gage bar or the second buttress in vicinity of the location of said overlapping by the gage bar have indicia for visually displaying the dimension of the gap; the hoop further comprising either an adjusting screw or an elastic tensile element extending across said gap and connecting said buttresses.

16. Apparatus for use in connection with an embroidering process, comprising:

an inner hoop having a bore, an outside periphery, an upper surface, and a lower surface lying in a lower surface plane;

an outer hoop having a bore shaped for mating with the outside periphery of the inner hoop;

the hoops shaped for holding, when mated, a first fabric taut across the bore of the inner hoop in said lower surface plane;

a fixture, for holding a fabric sub-element within the bore of the inner hoop in proximity to said lower surface plane, the fixture removably mounted on the upper surface of the inner hoop, the fixture having a multiplicity of tabs engaged with the inner hoop or the outer hoop, wherein each tab is only disengaged by means of exertion of upward force on the fixture, wherein each tab is one of (a) a tab comprising a downward extending lip which springily engages the inner hoop, (b) a tab which is magnetically susceptible and located in proximity to a magnet in one of said hoops, and (c) combinations thereof.

17. Apparatus for use in connection with an embroidering process, for holding one or more pieces of fabric, comprising:

a support bracket having a length and a width and a multiplicity of spaced apart mounting features, for supporting the apparatus on a hoop of an inner hoop and outer hoop combination that is shaped for holding within the bore of the inner hoop a first fabric piece for embroidering;

a pair of rail assemblies, comprising a first rail assembly and a second rail assembly, spaced apart and fastened to the support bracket, for clamping at least one piece of second fabric for embroidering;

each said first rail assembly and said second rail assembly having a length which is parallel to the length of support bracket and comprising a base, having a bottom surface and a top surface;

a cover, having a hinge edge and a free end spaced apart from the hinge edge, the hinge edge parallel to said bracket length, the cover hingedly attached to the base at the hinge edge and rotatable about the hinge edge from a first position where free end is raised up from the top surface of the base to a second position where the cover is substantially parallel to the top surface of the base; the cover having a lengthwise slot for pass-through of the at least one piece of second fabric when the fabric runs transverse to the length of the cover and the rail assembly;

wherein each rail assembly of said rail assembly pair is shaped and spaced with respect to the other rail assembly of said rail assembly pair so that when the cover is in said second position and a piece of second fabric runs as aforesaid, the at least one second piece fabric may run through the slot of the cover of a first rail assembly, between the cover free end and the top surface of the base of the first rail assembly, and across the space between the said pair of rail assemblies to the second rail assembly; and, at least one latch mounted on the base, for securing the cover in said second position.

18. The apparatus of claim 17 in combination with a said inner hoop and outer hoop combination, wherein the support bracket is removably supported on said inner hoop by said mounting features, further comprising (a) a first fabric piece held in place by the inner hoop and outer hoop combination and running across the bore of the inner hoop; and (b) a second fabric piece running between said rail assemblies and through each said slot of each said cover, the second fabric piece lying in close proximity to the first fabric piece where the first fabric piece runs across the bore of the inner hoop.

19. The hoop of claim 2 wherein the at least one spring is contained at least partially within a bore hole of the first buttress.

20. The hoop of claim 16, further comprising one or more tabs held in place by one or more screws.

21. The hoop of claim 17 wherein the free end of the cover has a lip, to engage second fabric which runs through the slot and across said base.

22. The hoop of claim 1 further comprising a rod journaled in the first buttress, the rod running to the second buttress, for limiting the extent to which said buttresses can separate.

* * * * *